US009309883B2

(12) United States Patent
Fujiki et al.

(10) Patent No.: US 9,309,883 B2
(45) Date of Patent: Apr. 12, 2016

(54) OIL PUMP

(75) Inventors: Kenichi Fujiki, Gunma-ken (JP); Masato Izutsu, Gunma-ken (JP)

(73) Assignee: Yamada Manufacturing Co. Ltd., Kiryu-shi, Gunma-ken (JP)

( * ) Notice: Subject to any disclaimer, the term of this patent is extended or adjusted under 35 U.S.C. 154(b) by 143 days.

(21) Appl. No.: 13/488,237

(22) Filed: Jun. 4, 2012

(65) Prior Publication Data

US 2012/0308423 A1 Dec. 6, 2012

(30) Foreign Application Priority Data

Jun. 6, 2011 (JP) ..... 2011-126786

(51) Int. Cl.

| | |
|---|---|
| ***F01C 1/00*** | (2006.01) |
| ***F03C 2/00*** | (2006.01) |
| ***F03C 4/00*** | (2006.01) |
| ***F04C 2/00*** | (2006.01) |
| ***F04C 18/00*** | (2006.01) |
| ***F04C 15/00*** | (2006.01) |
| ***F04C 2/08*** | (2006.01) |
| ***F04C 2/10*** | (2006.01) |

(52) U.S. Cl.

CPC ..... *F04C 2/088* (2013.01); *F04C 2/103* (2013.01); *F04C 15/0026* (2013.01); *F04C 15/0049* (2013.01)

(58) Field of Classification Search

CPC ..... F04C 15/0026; F04C 15/0042; F04C 15/0049; F04C 2/088; F04C 2/103

USPC ..... 418/171, 166, 102, 75; 417/440

See application file for complete search history.

(56) References Cited

U.S. PATENT DOCUMENTS

| | | | | |
|---|---|---|---|---|
| 4,199,305 | A | 4/1980 | Pareja | |
| 5,466,137 | A * | 11/1995 | Bierlein et al. | 418/75 |
| 7,384,251 | B2 * | 6/2008 | Fujiki et al. | 418/61.3 |

FOREIGN PATENT DOCUMENTS

| | | | | |
|---|---|---|---|---|
| DE | 43 30 586 | A1 | 9/1994 | |
| GB | 1 271 677 | | 4/1972 | |
| JP | 2010-096011 | A | 4/2010 | |
| WO | WO 2006136014 | A1 * | 12/2006 | F04C 2/08 |

OTHER PUBLICATIONS

European Search Report dated Sep. 5, 2012.

* cited by examiner

*Primary Examiner* — Jorge Pereiro
*Assistant Examiner* — Deming Wan
(74) *Attorney, Agent, or Firm* — McGinn IP Law Group, PLLC

(57) ABSTRACT

An oil pump includes: a rotor chamber; an outer rotor; and an inner rotor. A partition surface between a starting end side of the intake port and a terminal end side of the discharge port is set as a first seal land. An intake groove portion that projects from the starting end side of the intake port toward the terminal end side of the discharge port and a discharge groove portion that projects from the terminal end side of the discharge port toward the starting end side of the intake port are formed in positions which are located on the first seal land. The intake groove portion and the discharge groove portion are provided in intermediate tooth height direction positions of a meshing location between the inner rotor and the outer rotor.

19 Claims, 4 Drawing Sheets

ENLARGEMENT OF PART (ε)

ENLARGEMENT OF PART (Θ)

ENLARGEMENT OF PART (λ)

OIL PUMP

BACKGROUND OF THE INVENTION

1. Field of the Invention

The present invention relates to an oil pump capable of suppressing an increase in friction and the occurrence of cavitation and pumping loss.

2. Description of the Related Art

Japanese Patent Application Publication No. 2010-96011 is available as an internal gear pump according to the related art. In Japanese Patent Application Publication No. 2010-96011 (reference symbols provided in the description of Japanese Patent Application Publication No. 2010-96011 are used as is), a passage 11 is provided to extend forward in a rotor rotation direction from a terminal end of a discharge port 7, and fluid pressure is introduced through the passage 11 from the discharge port 7 into a pump chamber 10 that has moved to a position where a capacity thereof is minimized.

A force for separating an inner rotor 4 from an outer rotor 3 is generated on an upper side of a part where the pump chamber 10 is confined by the fluid pressure, and a force for pressing teeth of the inner rotor 4 and teeth of the outer rotor 3 against each other is generated in the rotor on an opposite lower side. Thus, a tip clearance of a pump chamber 10 confining portion is reduced so that liquid leakage through the tip clearance is suppressed, and as a result, a reduction in volumetric efficiency is prevented.

A space g generated between a tooth tip of the inner rotor 4 and a tooth bottom of the outer rotor 3 in the position where the capacity of the pump chamber 10 is minimized communicates with the discharge port 7 via a groove 11*a*, and therefore, to connect the space g to the groove 11*a*, the groove 11*a* is provided in a position where the tooth tip of the inner rotor 4 slides against the tooth bottom of the outer rotor 3. Communication between the pump chamber 10 and both an intake port 6 and the discharge port 7 must be blocked temporarily between a discharge end point and an intake start point, and therefore the pump chamber 10 is provided with an escape portion 12 to let out (displace) a part of a starting end of the intake port 6 forward in the rotor rotation direction.

SUMMARY OF THE INVENTION

By providing the escape portion 12 to let out (displace) a part of a starting end of the intake port 6 forward in the rotor rotation direction, an intake timing is delayed such that when a cell communicates with the intake port, a rapid increase occurs in a cell surface area, leading to a rapid pressure reduction. As a result, an increase in friction and cavitation occur. An object of (a technical problem to be solved by) the present invention is to provide an oil pump capable of suppressing an increase in friction and the occurrence of cavitation and pumping loss.

As a result of much committed research undertaken by the inventor to solve the problem described above, the problem was solved by providing, as a first aspect of the present invention, an oil pump including: a rotor chamber having an intake port and a discharge port; an outer rotor having inner teeth and housed in the rotor chamber; and an inner rotor having outer teeth, wherein a partition surface between a starting end side of the intake port and a terminal end side of the discharge port is set as a first seal land, an intake groove portion that projects from the starting end side of the intake port toward the terminal end side of the discharge port and a discharge groove portion that projects from the terminal end side of the discharge port toward the starting end side of the intake port are formed in positions which are located on the first seal land and over which a cell formed when the outer teeth of the inner rotor and the inner teeth of the outer rotor are most deeply meshed passes, and the intake groove portion and the discharge groove portion are provided in intermediate tooth height direction positions of a meshing location between the outer teeth of the inner rotor and the inner teeth of the outer rotor.

Further, the problem described above was solved by providing, as a second aspect of the present invention, the oil pump according to the present invention, wherein the discharge groove portion is formed to be longer than the intake groove portion.

Furthermore, the problem described above was solved by providing, as a third aspect of the present invention, the oil pump according to the present invention, wherein the intake groove portion is formed to be longer than the discharge groove portion. The problem described above was also solved by providing, as a forth aspect of the present invention, the oil pump according to the present invention, wherein the intake groove portion is formed to have an equal length to the discharge groove portion.

In the first aspect of the present invention, the partition between the starting end side of the intake port and the terminal end side of the discharge port is set as the first seal land, the intake groove portion is formed to project from the starting end side of the intake port toward the terminal end side of the discharge port, and the discharge groove portion is formed from the terminal end side of the discharge port to the starting end side of the intake port.

In particular, the intake groove portion and the discharge groove portion are provided in an intermediate tooth height direction position of the meshing location between the outer teeth of the inner rotor and the inner teeth of the outer rotor, and therefore a pressure increase or decrease caused by rapid variation in a surface area of the cell moving over the first seal land can be prevented. Moreover, friction can be suppressed. Further, pumping loss occurring in a situation where the cell is caused to communicate with the discharge port in a compression stroke of the cell, the communication between the cell and the discharge port is blocked, and then compression is performed erroneously in a resulting sealed space can be suppressed.

With the second aspect of the invention, oil in the cell in the deepest meshing location between the outer teeth of the inner rotor and the inner teeth of the outer rotor moving over the first seal land can be discharged to the discharge groove portion over a long time period, and therefore discharge amount loss can be suppressed.

With the third aspect of the invention, oil in the cell in the deepest meshing location between the outer teeth of the inner rotor and the inner teeth of the outer rotor moving over the first seal land can be taken into the intake groove portion over a long time period, and therefore loss in an intake amount of the intake port can be suppressed.

With the forth aspect of the invention, oil in the cell in the deepest meshing location between the outer teeth of the inner rotor and the inner teeth of the outer rotor moving over the first seal land can be discharged to the discharge groove portion and taken into the intake groove portion with favorable balance, and therefore a reduction in the efficiency of the pump can be suppressed.

DESCRIPTION OF THE PREFERRED EMBODIMENTS

Figure 1A:
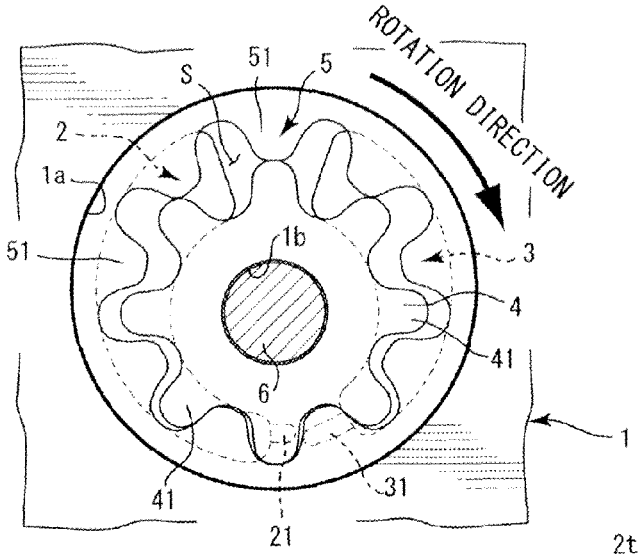
FIG. 1A is a front view showing a configuration of the present invention.

Embodiments of the present invention will be described below on the basis of the drawings. As shown in FIG. 1A, a housing 1, an inner rotor 4, and an outer rotor 5 serve as main constituent components of the present invention. In the present invention, the inner rotor 4 and the outer rotor 5 together constitute an internal gear pump.

The inner rotor 4 and the outer rotor 5, which has one more tooth than the inner rotor 4, are disposed eccentrically such that respective center positions thereof are offset, and housed in a rotor chamber 1*a* of the housing 1. In the inner rotor 4, a plurality of outer teeth 41 provided on an outer peripheral side mesh with a plurality of inner teeth 51 of the outer rotor 5. A tooth height of the outer teeth 41 provided on the inner rotor 4 may be set to be greater than a tooth height of the inner teeth 51 provided on the outer rotor 5.

The inner rotor 4 and the outer rotor 5 constitute an internal gear pump in which spaces (to be referred to hereafter as cells S) are formed between tooth side faces (parts forming a tooth thickness) of the inner rotor 4 and tooth side faces (parts forming a tooth thickness) of the outer rotor 5 in a deepest meshing condition. The deepest meshing condition is a condition in which an outer tooth 41 of the inner rotor 4 is inserted most deeply between adjacent inner teeth 51 of the outer rotor 5.

The rotor chamber 1*a* is formed in the housing 1 to house the outer rotor 5 and the inner rotor 4 (see FIG. 1A). A shaft receiving hole 1*b* for inserting a drive shaft 6 that drives the inner rotor 4 to rotate is formed in the rotor chamber 1*a*. Further, an intake port 2 and a discharge port 3 are formed in the rotor chamber 1*a*.

Figure 1B:
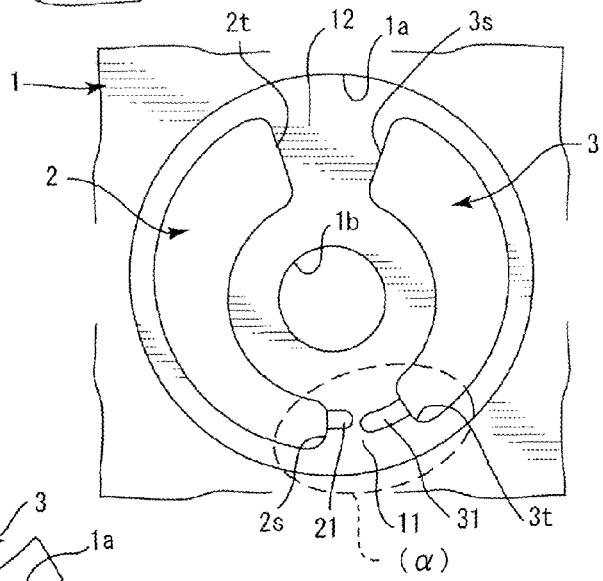
FIG. 1B is a front view showing a rotor chamber of a housing.

The intake port 2 and the discharge port 3 are arc-shaped grooves. Respective sides of the intake port 2 and the discharge port 3 on which the teeth (the outer teeth 41 and the inner teeth 51) and the cells S enter in a rotation direction of the inner rotor 4 and the outer rotor 5 are set as starting end sides, and sides from which the teeth (the outer teeth 41 and the inner teeth 51) and the cells S exit are set as terminal end sides (see FIG. 1B). A first seal land 11 is formed between a starting end side 2*s* of the intake port 2 and a terminal end side 3*t* of the discharge port 3, and a second seal land 12 is formed between a terminal end side 2*t* of the intake port 2 and a starting end side 3*s* of the discharge port 3.

In the first seal land 11, the inner rotor 4 and the outer rotor 5 move over the first seal land 11 in the deepest meshed condition from the terminal end side 3*t* of the discharge port 3 toward the starting end side 2*s* of the intake port 2 (see FIGS. 1A, 2, and 3). Further, in the second seal land 12, the cell S in which the outer teeth 41 of the inner rotor 4 and the inner teeth 51 of the outer rotor 5 form the substantially largest space moves from the terminal end side 2*t* of the intake port 2 toward the starting end side 3*s* of the discharge port 3 (see FIG. 1A).

An intake groove portion 21 is formed in the first seal land 11 to extend from the starting end side 2*s* of the intake port 2 toward the terminal end side 3*t* of the discharge port 3. The intake groove portion 21 is a groove passage having a substantially intermediate meshing position between the outer teeth 41 of the inner rotor 4 and the inner teeth 51 of the outer rotor 5 as a locus. The intake groove portion 21 is connected to the starting end side 2*s* of the intake port 2 but not connected to the terminal end side 3*t* of the discharge port 3.

Further, a discharge groove portion 31 is formed in the first seal land 11 to extend from the terminal end side 3*t* of the discharge port 3 toward the starting end side 2*s* of the intake port 2. The discharge groove portion 31, similarly to the intake groove portion 21, is a groove passage having a substantially intermediate meshing position between the outer teeth 41 of the inner rotor 4 and the inner teeth 51 of the outer rotor 5 as a locus. The discharge groove portion 31 is connected to the terminal end side 3*t* of the discharge port 3 but not connected to the starting end side 2*s* of the intake port 2.

The intake groove portion 21 and the discharge groove portion 31 are respectively positioned in intermediate tooth height direction positions in a meshing location between the outer teeth 41 of the inner rotor 4 and the inner teeth 51 of the outer rotor 5. The intake groove portion 21 and the discharge groove portion 31 are disposed at a slight offset from each other in the height direction of the outer teeth 41 and the inner teeth 51.

A groove depth of the intake groove portion 21 and the discharge groove portion 31 is set to be shallower than (see FIG. 1D) or equal to a depth of the intake port 2 and the discharge port 3. The intake groove portion 21 and the discharge groove portion 31 may be formed at equal distances from a rotary center of the inner rotor 4. Further, the discharge groove portion 31 may be formed closer to the rotary center of the inner rotor 4 than the intake groove portion 21.

Figure 1C:
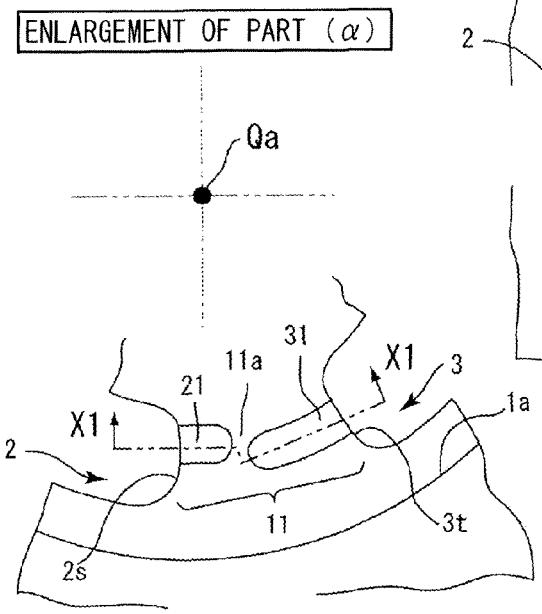
FIG. 1C is an enlarged view of a part (α) of FIG. 1B.
Figure 1D:
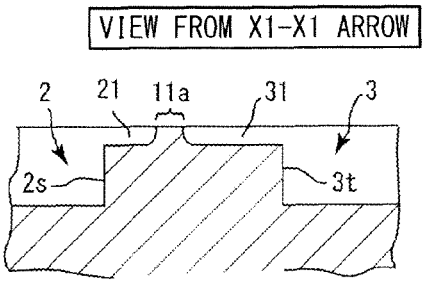
FIG. 1D is a sectional view taken along an arrow X1-X1 in FIG. 1C.
Figure 2A:
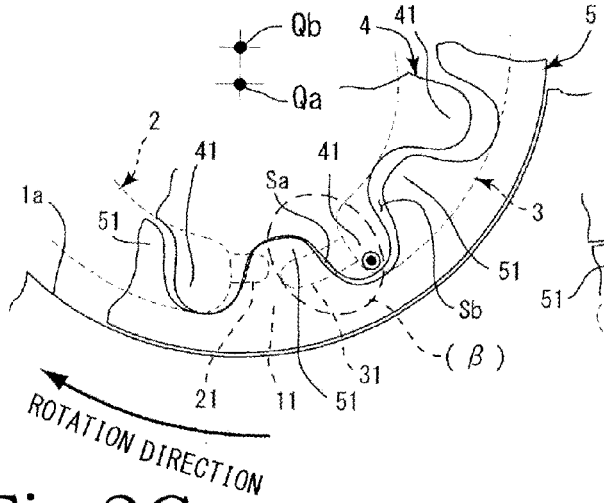
FIG. 2A is a view showing a condition in which an arbitrary cell moves over a discharge groove portion of a discharge port.
Figure 2B:
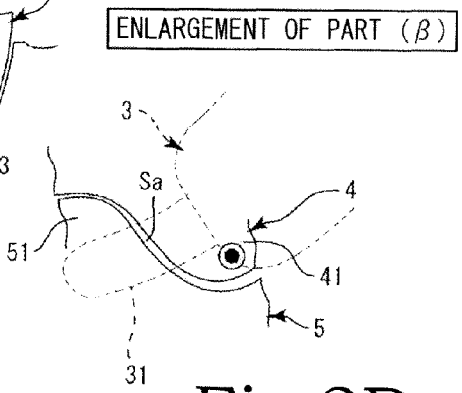
FIG. 2B is an enlarged view of a part (β) of FIG. 2A.
Figure 2C:
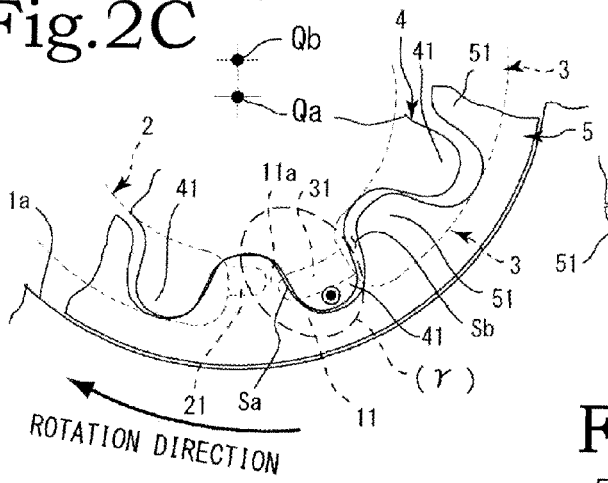
FIG. 2C is a view showing a condition in which the arbitrary cell has reached a terminal end of the discharge groove portion of the discharge port.
Figure 2D:
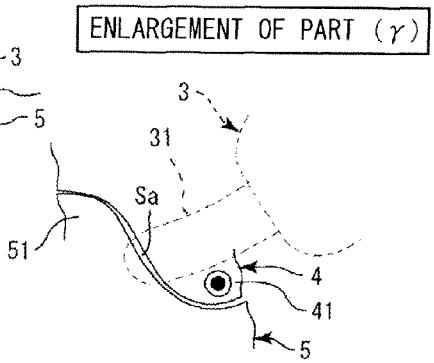
FIG. 2D is an enlarged view of a part (γ) of FIG. 2C.
Figure 2E:
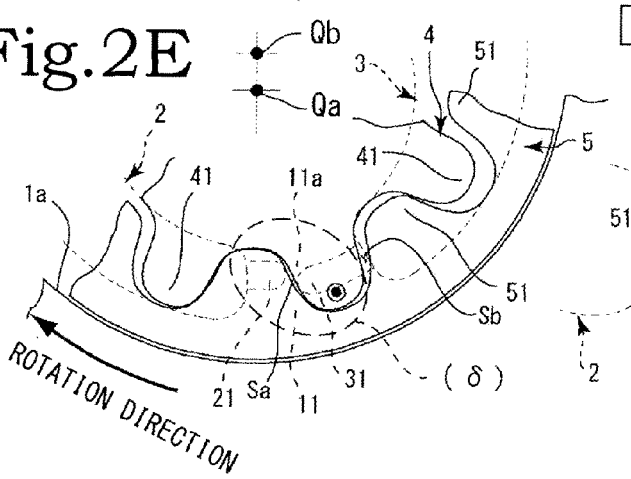
FIG. 2E is a view showing a condition in which the arbitrary cell has reached a region where no contact occurs with either the discharge groove portion of the discharge port or an intake groove portion of an intake port.
Figure 2F:
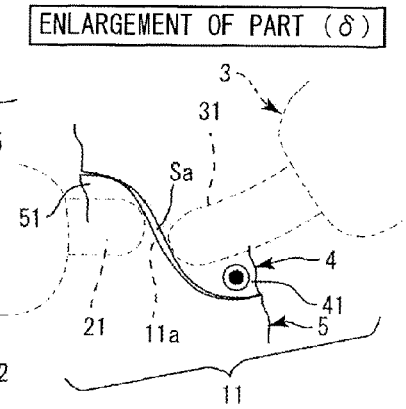
FIG. 2F is an enlarged view of a part (δ) of FIG. 2E.
Figure 3A:
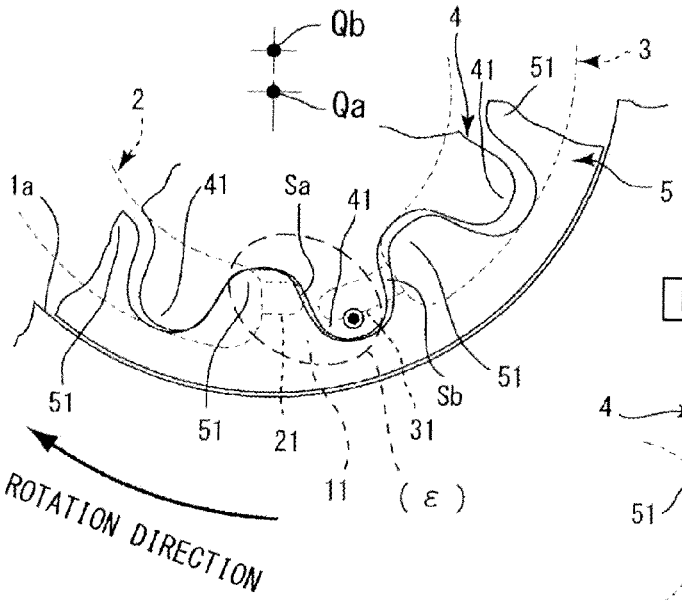
FIG. 3A is a view showing a condition in which the arbitrary cell has reached the intake groove portion of the intake port.
Figure 3B:
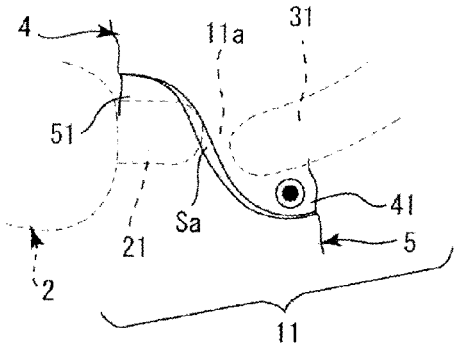
FIG. 3B is an enlarged view of a part (ϵ) of FIG. 3A.
Figure 3C:
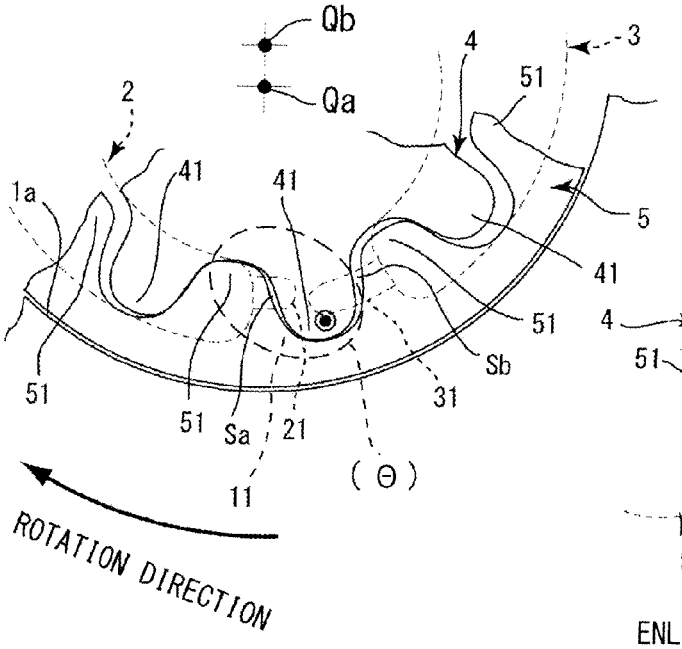
FIG. 3C is a view showing a condition in which the arbitrary cell moves over the intake groove portion of the intake port.
Figure 3D:
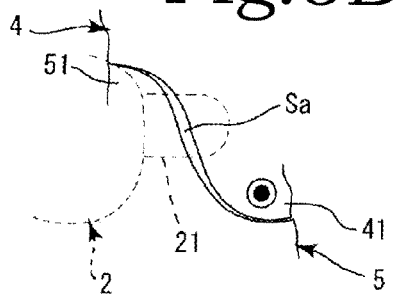
FIG. 3D is an enlarged view of a part (θ) of FIG. 3C.

Opposing end portions of the intake groove portion 21 and the discharge groove portion 31 are close to each other but separated from each other (see FIG. 1C). A surface formed in the first seal land 11 between the opposing end portions of the intake groove portion 21 and the discharge groove portion 31 will be referred to as a partition surface 11*a*. On the partition surface 11*a*, a moving cell S contacts neither the intake groove portion 21 nor the discharge groove portion 31 (see FIGS. 2E and 2F). In other words, on the partition surface 11*a*, the cell S is sealed such that oil is confined therein.

Here, the rotary center of the inner rotor 4 housed in the rotor chamber 1*a* is set as a center Qa, while a rotary center of the outer rotor 5 housed in the rotor chamber 1*a* is set as a center Qb. Respective positions of the center Qa and the center Qb are offset. Further, the cell S formed in the deepest meshing condition between the outer tooth 41 of the inner rotor 4 and the inner tooth 51 of the outer rotor 5 has a smaller surface area than the cells S formed in other positions, and therefore this cell S has a minimum surface area.

Next, operation conditions of the outer teeth 41 of the inner rotor 4 and the inner teeth 51 of the outer rotor 5 in the vicinity of the first seal land 11 will be described. An arbitrary outer tooth 41 that moves over the first seal land 11 in the rotation direction has been set for convenience and marked with a double circle (see FIGS. 2 and 3).

Further, using the aforesaid arbitrary outer tooth 41 as a reference, a cell on the intake side thereof, from among the cells S that move over the first seal land 11, will be referred to as an intake side cell Sa and a cell on the discharge side will be referred to as a discharge side cell Sb. When the intake side cell Sa passes over the first seal land 11, an expansion stroke takes place (see FIGS. 2A to 2D). Further, the intake side cell Sa is always formed on a front side of the arbitrary outer tooth 41 in the rotation direction of the inner rotor 4 and the outer rotor 5, whereas the discharge side cell Sb is always formed on a rear side in the rotation direction. Having reached the partition surface 11*a* of the first seal land 11, the intake side cell Sa is sealed, and as a result, oil is confined therein (see FIGS. 2E and 2F).

Hence, the intake side cell Sa communicates with the intake groove portion 21 in the expansion stroke such that communication with the intake port 2 is established early. Therefore, a rapid pressure reduction in the intake side cell Sa can be prevented, and as a result, the occurrence of cavitation can be suppressed (see FIG. 3). Further, when the discharge side cell Sb passes over the first seal land 11, a compression stroke takes place. In the compression stroke, the discharge side cell Sb communicates with the discharge groove portion 31 so as to establish communication also with the discharge port 3, and as a result, pumping loss is suppressed.

Figure 4A:
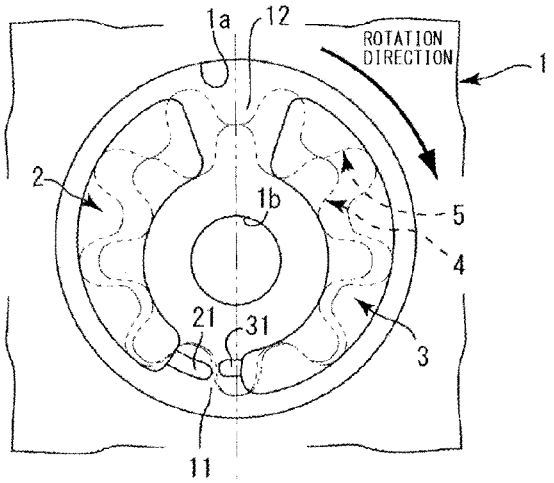
FIG. 4A is a front view showing a configuration of a second embodiment of the rotor chamber according to the present invention.
Figure 4B:
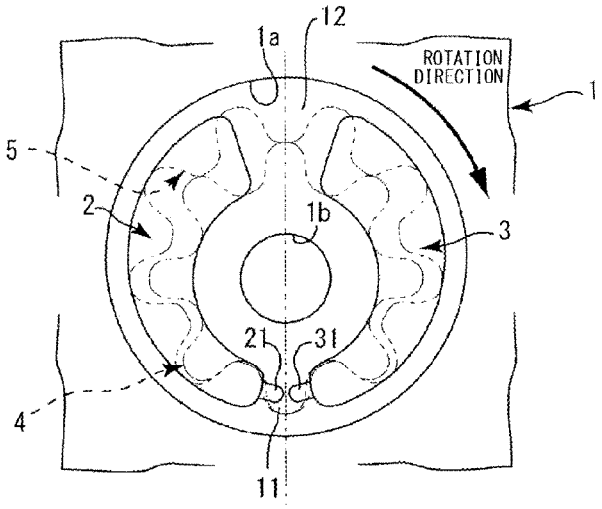
FIG. 4B is a front view showing a configuration of a third embodiment of the rotor chamber according to the present invention.

In a second embodiment, the first seal land 11 is shifted to the intake port 2 side, and the intake groove portion 21 is formed to be longer than the discharge groove portion 31 (see FIG. 4A). Likewise in the second embodiment, pumping loss and cavitation are suppressed. In a third embodiment, the intake groove portion 21 and the discharge groove portion 31 are formed at identical lengths and provided in left-right symmetry about a line drawn through the center of the inner rotor 4 (see FIG. 4B). Likewise in the third embodiment, pumping loss and cavitation are suppressed.

Figure 4C:
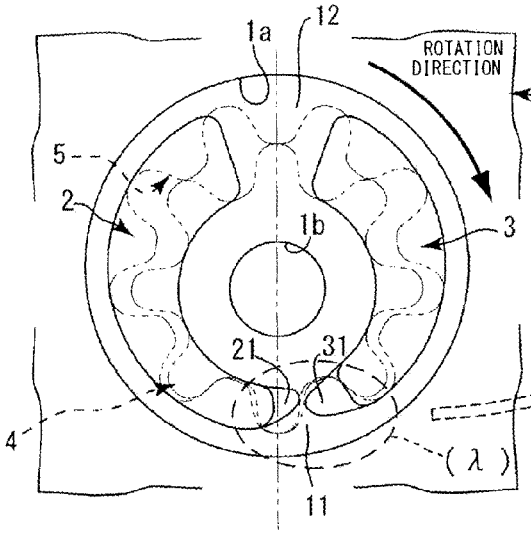
FIG. 4C is a front view showing a configuration of a fourth embodiment of the rotor chamber according to the present invention.
Figure 4D:
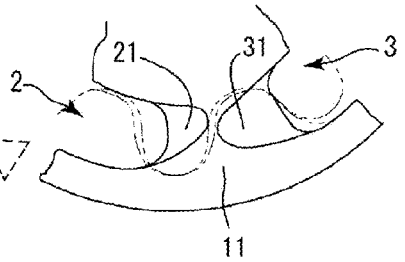
FIG. 4D is an enlarged view of a part (λ) of FIG. 4C.

In a fourth embodiment, respective groove thicknesses of the intake groove portion 21 and the discharge groove portion 31 are not fixed. The thickness of the starting end side 2*s* of the intake port 2 and the thickness of the intake grove portion 21 connected thereto may be identical, the thickness of the terminal end side 3*t* of the discharge port 3 and the thickness of the discharge grove portion 31 connected thereto may be identical, and the respective end portions of the intake groove portion 21 and the discharge groove portion 31 may be positioned in intermediate tooth height direction positions in the meshing location between the outer teeth 41 of the inner rotor 4 and the inner teeth 51 of the outer rotor 5 (see FIGS. 4C and 4D).

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. An oil pump comprising:

a rotor chamber having an intake port and a discharge port;

an outer rotor having inner teeth and housed in the rotor chamber;

an inner rotor having outer teeth and housed in the rotor chamber, respective sides of the intake port and the discharge port on which the inner teeth of the outer rotor and the outer teeth of the inner rotor enter in a rotation direction of the inner rotor and the outer rotor being set as starting end sides, and sides from which the inner teeth and the outer teeth exit in the rotation direction being set as terminal end sides;

a first seal land comprising a partition surface between a starting end side of the intake port and a terminal end side of the discharge port;

an intake groove portion formed in the first seal land and projecting from the starting end side of the intake port toward the terminal end side of the discharge port; and a discharge groove portion formed in the first seal land and projecting from the terminal end side of the discharge port toward the starting end side of the intake port, an end portion of the intake groove portion being close to but separated from an end portion of the discharge groove portion which opposes the end portion of the intake groove portion, of a plurality of cells that pass over the first seal land, an intake side cell formed on a rotation direction front side, using the outer teeth of the inner rotor as a reference, passes over the first seal land during an expansion stroke and a discharge side cell formed on a rotation direction rear side passes over the first seal land during a compression stroke, wherein the intake groove portion and the discharge groove portion comprise groove passages having an intermediate meshing position between the outer teeth of the inner rotor and the inner teeth of the outer rotor as a locus, wherein the end portion of the intake groove portion is not positioned in respective tooth height direction end positions in the meshing location of a starting end portion of the intake port, and wherein the end portion of the discharge groove portion is not positioned in respective tooth height direction end positions in the meshing location of a terminal end portion of the discharge port.

2. The oil pump according to claim 1, wherein the intake and discharge groove portions are formed at a position on the first seal land over which a cell formed when the outer teeth of the inner rotor and the inner teeth of the outer rotor are most deeply meshed passes.

3. The oil pump according to claim 1, wherein the intake and discharge groove portions are provided in intermediate tooth height direction positions of a meshing location between the outer teeth of the inner rotor and the inner teeth of the outer rotor.

4. An oil pump comprising:

a rotor chamber having an intake port and a discharge port;

an outer rotor having inner teeth and housed in the rotor chamber; and an inner rotor having outer teeth and housed in the rotor chamber, wherein respective sides of the intake port and the discharge port on which the inner teeth of the outer rotor and the outer teeth of the inner rotor enter in a rotation direction of the inner rotor and the outer rotor are set as starting end sides, and sides from which the inner teeth and the outer teeth exit in the rotation direction are set as terminal end sides, a partition surface between a starting end side of the intake port and a terminal end side of the discharge port is set as a first seal land, an intake groove portion that projects from the starting end side of the intake port toward the terminal end side of the discharge port and a discharge groove portion that projects from the terminal end side of the discharge port toward the starting end side of the intake port are formed in positions which are located on the first seal land and over which a cell formed when the outer teeth of the inner rotor and the inner teeth of the outer rotor are most deeply meshed passes, the intake groove portion and the discharge groove portion are provided in intermediate tooth height direction positions of a meshing location between the outer teeth of the inner rotor and the inner teeth of the outer rotor, an end portion of the intake groove portion is close to but separated from an end portion of the discharge groove portion which opposes the end portion of the intake groove portion, of a plurality of cells that pass over the first seal land, an intake side cell formed on a rotation direction front side, using the outer teeth of the inner rotor as a reference, passes over the first seal land during an expansion stroke and a discharge side cell formed on a rotation direction rear side passes over the first seal land during a compression stroke, the intake groove portion and the discharge groove portion comprise groove passages having an intermediate meshing position between the outer teeth of the inner rotor and the inner teeth of the outer rotor as a locus, the end portion of the intake groove portion is not positioned in respective tooth height direction end positions in the meshing location of a starting end portion of the intake port, and the end portion of the discharge groove portion is not positioned in respective tooth height direction end positions in the meshing location of a terminal end portion of the discharge port.

5. The oil pump according to claim 4, wherein the discharge groove portion is formed to be longer than the intake groove portion.

6. The oil pump according to claim 4, wherein the intake groove portion is formed to be longer than the discharge groove portion.

7. The oil pump according to claim 4, wherein the intake groove portion is formed to have an equal length to the discharge groove portion.

8. The oil pump according to claim 4, wherein the intake groove portion is disposed to be offset from the discharge groove portion in a height direction of the inner and outer teeth.

9. The oil pump according to claim 4, wherein a depth of the intake groove portion and the discharge groove portion is equal to or less than a depth of the intake port and a depth of the discharge port.

10. The oil pump according to claim 4, wherein the plurality of cells are formed between a tooth side face of the inner rotor and a tooth side face of the outer rotor, and a moving cell of the plurality of cells which is disposed on the partition surface is separated from the intake groove portion and the discharge groove portion.

11. The oil pump according to claim 10, wherein on the partition surface, the moving cell contacts neither the intake groove portion nor the discharge groove portion, such that on the partition surface the moving cell is sealed such that oil is confined in the moving cell.

12. The oil pump according to claim 4, wherein a number of teeth of the outer rotor is greater than a number of teeth of the inner rotor, and a tooth height of the outer teeth formed on the inner rotor is greater than a tooth height of the inner teeth formed on the outer rotor.

13. The oil pump according to claim 4, wherein the outer rotor is disposed eccentrically with the inner rotor such that a center position of the outer rotor is offset from a center position of the inner rotor.

14. The oil pump according to claim 4, wherein the plurality of cells comprises a plurality of spaces that are formed between tooth side faces of the inner rotor and tooth side faces of the outer rotor in a deepest meshing condition in which an outer tooth of the inner rotor is inserted most deeply between adjacent inner teeth of the outer rotor.

15. The oil pump according to claim 4, wherein the intake side cell communicates with the intake groove portion in the expansion stroke such that communication with the intake port is established, inhibiting a rapid pressure reduction in the intake side cell.

16. The oil pump according to claim 4, wherein in the compression stroke, the discharge side cell communicates with the discharge groove portion so as to establish communication with the discharge port, to suppress a pumping loss.

17. The oil pump according to claim 4, further comprising: a partition surface between a starting end side of the discharge port and a terminal end side of the intake port is set as a second seal land, wherein a width of the second seal land is greater than a width of the first seal land, and wherein a width of the starting end side of the discharge port is greater than a width of the terminal end side of the discharge port, and a width of the terminal end side of the intake port is greater than a width of the starting end side of the intake port.

18. The oil pump according to claim 4, wherein the intake side cell comprises a space formed between the inner teeth of the outer rotor and the rotation direction front side of the outer teeth of the inner rotor in a deepest meshing condition, and the discharge side cell comprises a space formed between the inner teeth of the outer rotor and the rotation direction rear side of the outer teeth of the inner rotor in a deepest meshing condition.

19. An oil pump comprising:

a rotor chamber having an intake port and a discharge port;

an outer rotor having inner teeth and housed in the rotor chamber; and an inner rotor having outer teeth and housed in the rotor chamber, wherein respective sides of the intake port and the discharge port on which the inner teeth of the outer rotor and the outer teeth of the inner rotor enter in a rotation direction of the inner rotor and the outer rotor are set as starting end sides, and sides from which the inner teeth and the outer teeth exit in the rotation direction are set as terminal end sides, a partition surface between a starting end side of the intake port and a terminal end side of the discharge port is set as a first seal land, an intake groove portion that projects from the starting end side of the intake port toward the terminal end side of the discharge port and a discharge groove portion that projects from the terminal end side of the discharge port toward the starting end side of the intake port are formed in positions which are located on the first seal land and over which a cell formed when the outer teeth of the inner rotor and the inner teeth of the outer rotor are most deeply meshed passes, the intake groove portion and the discharge groove portion are provided in intermediate tooth height direction positions of a meshing location between the outer teeth of the inner rotor and the inner teeth of the outer rotor, an end portion of the intake groove portion is close to but separated from an end portion of the discharge groove portion which opposes the end portion of the intake groove portion, of a plurality of cells that pass over the first seal land, an intake side cell formed on a rotation direction front side, using the outer teeth of the inner rotor as a reference, passes over the first seal land during an expansion stroke and a discharge side cell formed on a rotation direction rear side passes over the first seal land during a compression stroke, the intake groove portion and the discharge groove portion comprise groove passages having an intermediate meshing position between the outer teeth of the inner rotor and the inner teeth of the outer rotor as a locus, the end portion of the intake groove portion is not positioned in respective tooth height direction end positions in the meshing location of a starting end portion of the intake port, the end portion of the discharge groove portion is not positioned in respective tooth height direction end positions in the meshing location of a terminal end portion of the discharge port, a number of teeth of the outer rotor is greater than a number of teeth of the inner rotor, and a tooth height of the outer teeth formed on the inner rotor is greater than a tooth height of the inner teeth formed on the outer rotor, the outer rotor is disposed eccentrically with the inner rotor such that a center position of the outer rotor is offset from a center position of the inner rotor, the plurality of cells comprises a plurality of spaces that are formed between tooth side faces of the inner rotor and tooth side faces of the outer rotor in a deepest meshing condition in which an outer tooth of the inner rotor is inserted most deeply between adjacent inner teeth of the outer rotor, on the partition surface, the moving cell contacts neither the intake groove portion nor the discharge groove portion, such that on the partition surface the moving cell is sealed such that oil is confined therein, the intake side cell communicates with the intake groove portion in the expansion stroke such that communication with the intake port is established, inhibiting a rapid pressure reduction in the intake side cell, and in the compression stroke, the discharge side cell communicates with the discharge groove portion so as to establish communication with the discharge port, to suppress a pumping loss.

* * * * *